United States Patent [19]

Mann

[11] Patent Number: 5,036,816

[45] Date of Patent: Aug. 6, 1991

[54] LOAD ADJUSTMENT DEVICE

[75] Inventor: Arnold Mann, Biebergemünd, Fed. Rep. of Germany

[73] Assignee: VDO Adolf Schindling AG, Frankfurt/Main, Fed. Rep. of Germany

[21] Appl. No.: 485,210

[22] Filed: Feb. 23, 1990

[30] Foreign Application Priority Data

Mar. 23, 1989 [DE] Fed. Rep. of Germany ..... 3909570

[51] Int. Cl.[5] ..... F02D 9/02

[52] U.S. Cl. ..... 123/361; 123/399; 123/336; 137/637.1; 137/637.3; 251/129.11

[58] Field of Search ..... 123/361, 399, 336; 251/129.11; 137/625.31, 637.1, 637.3

[56] References Cited

U.S. PATENT DOCUMENTS

| | | | |
|---|---|---|---|
| 3,897,524 | 7/1975 | Freismuth et al. | 123/23 A |
| 3,934,851 | 1/1976 | Illing | 137/637.3 |
| 4,163,432 | 8/1979 | Hertfelder | 123/361 |
| 4,246,115 | 1/1981 | Swank | 137/637.1 |
| 4,768,483 | 9/1988 | Asayama | 123/361 |
| 4,809,656 | 3/1989 | Suzuki | 123/361 |
| 4,809,659 | 3/1989 | Tamaki et al. | 123/361 |
| 4,827,884 | 5/1989 | Cook | 123/361 |
| 4,846,225 | 7/1989 | Scobie et al. | 137/637.1 |
| 4,850,319 | 7/1989 | Imoehl | 251/129.11 |

FOREIGN PATENT DOCUMENTS

| | | | |
|---|---|---|---|
| 1172089 | 6/1964 | Fed. Rep. of Germany | 137/637.3 |
| 3108090 | 9/1982 | Fed. Rep. of Germany . | |
| 3810270 | 10/1988 | Fed. Rep. of Germany . | |
| 2163256 | 6/1973 | France . | |

OTHER PUBLICATIONS

Patent Abstracts of Japan, vol. 13, No. 143 Apr. 7, 1989, JAP-A-63 306252 12/14/1988.

Patent Abstracts of Japan, vol. 7, No. 165, (M-230)(1310) Jul. 20, 1983 & JP-A-58 072615 4/30/1983.

*Primary Examiner*—Andrew M. Dolinar
*Assistant Examiner*—Thomas N. Moulis
*Attorney, Agent, or Firm*—Martin A. Farber

[57] ABSTRACT

In a throttle-valve connection (1), two intake channels (2, 3) are provided alongside of each other, each having a throttle valve (4, 5). The two throttle valve (4, 5) are driven by separate setting motors (17, 18). The setting shaft (6, 7) of the throttle valve (4, 5) are connected to each other by an entrainment connection (8) which has play. Sliding clutches (9, 10) permit rotation of the throttle valve (6, 7) in the direction towards idling even if the gearing (11, 12) or setting motor (17, 18) is blocked.

12 Claims, 2 Drawing Sheets

LOAD ADJUSTMENT DEVICE

FIELD AND BACKGROUND OF THE INVENTION

The present invention relates to a load adjustment device having a throttle valve which is arranged in an air and fuel intake channel of an internal combustion engine, and wherein a setting shaft of the device is actuated by a setting motor.

Load adjustment devices of this type have been frequently used recently instead of mechanical load adjustment devices in which the accelerator pedal of a motor vehicle is connected via a rod or cable with the throttle valve of the engine. Electrical transfer of the movement of the accelerator pedal to the throttle valve has a number of advantages over mechanical transfer; in particular, the laying of electric transmission lines is substantially less expensive than the providing of a mechanical transmission device. For reasons of safety, however, one does not dispense completely with the mechanical transmission device but provides, in addition, a so-called emergency actuation device having play so that, in the event of the failure of the electric device, mechanical actuation of the throttle valve is possible after overcoming the play. This additional mechanical emergency actuation device which is provided for reasons of redundancy naturally considerably increases the cost of such a load adjustment device.

SUMMARY OF THE INVENTION

It is an object of the invention so to develop a load adjustment device of the aforementioned type at the lowest possible expense and in such a manner that actuation is still possible even in the event of the failure of critical components.

According to the invention there is provided, parallel to the air and fuel intake channel (2) of the engine, a second intake channel (3) having a further throttle valve (5), the setting device of the second throttle valve (5) being also driven by a setting motor (18). Both throttle valves (4, 5) are arranged completely swingably in the intake channel (2, 3), there being two setting shafts (6, 7) which are connected to each other by an entrainment connection (8) which is provided wit play.

By this division of the stream of air over two intake channels, each having a throttle valve, and by the provision of a total of two setting motors, a high degree of redundancy is obtained at very low cost. Since a total of two setting motors are provided, should one setting motor fail, the other can still move the throttle valve associated with the setting motor which has failed into closed position; this occurs in the manner that the throttle valve which is still functional is swung out beyond the play of the entrainment device and thereby carries the other throttle valve along. Since the entrainment connection has play, after a setting back of the throttle valve having the defective drive, normal operation of the other throttle valve is possible with normal setting forces. With only one throttle valve functioning, a motor vehicle can be operated in normal manner in the partial-load range with all the control functions with which the system is provided. Only the upper full-load region is no longer obtainable.

Due to the invention, no return springs or uncoupling springs are necessary for the load adjustment device, so that the opposing forces on the accelerator pedal are less and can be determined better. Another advantage of the entrainment connection with play is that each throttle valve can be adjusted over its setting range independently of the other and that, only after this play has been overcome, does coupling wIth the other throttle valve take place.

One particularly advantageous embodiment of the invention provides that the setting motors (17, 18) are developed as stepping motors. The provision of stepping motors has the advantage that expensive feedback potentiometers for the throttle valves and thus also the expensive laying of feedback lines can be dispensed with. It is sufficient if a simple switch produces a signal when throttle valve is closed so that, upon actuation of the accelerator pedal, the zero position can be noted. Another advantage of stepping motors is that they have small commutators so that a problem resulting from oscillations of carbon brushes which lift-off a commutator does not occur.

The load adjustment device is particularly compact if, in accordance with another embodiment of the invention, the setting motors (17, 18) are arranged as mirror images to each other above or below the two intake channels (2, 3) and are connected to the corresponding setting shaft (6, 7) via, in each case, a gearing (11, 12) arranged laterally of the corresponding intake channel (2, 3).

It is advantageous if, in each case, a sliding clutch which permits limited rotary movement is provided between the gearing (11, 12) and the associated setting shaft (6). In this way, emergency actuation is possible even if the gearing is blocked as the result of a defect. The limiting of the maximum possible relative movements of the two sliding clutches is necessary so that, via the sliding clutch of the side which is driving at the time, the setting shaft of the other side can be turned, by rotation of the other sliding clutch, to such an extent that the corresponding throttle valve comes into closed position. In the case of the load adjustment device of the invention, the defective throttle valve is set back against the force of the sliding clutch associated with it but then, due to the play of the entrainment device, regulates the functioning throttle valve without opposing frictional force.

Another very advantageous development of the invention is that the play of the entrainment connection (8), in the case of throttle valves (4, 5) directed in the same direction, towards both sides amounts in each case to about 90 degrees and the two sliding clutches (10, 11) are so designed that they engage in form-locking manner after a relative rotation of 90 degrees. By this fixing of the play at 90 degrees, a complete actuation of the throttle valve which is still intact is possible without the frictional force of a sliding clutch opposing this.

The idling performance of the load adjustment device can be adjusted with particular sensitivity if the load adjustment device has a control device for actuating only one setting motor (17 or 18) for idling adjustment and for synchronous actuation of both throttle valves (17, 18) in operation under load.

A failure of a throttle-valve drive can be noted in simple manner if both setting shafts (6, 7) have associated with them a safety switch contact (19, 20) for monItoring rotary movement of the corresponding setting shaft (6, 7).

The load adjustment device is particularly simple from a structural standpoint if, in accordance with another embodiment of the invention, the entrainment connection (8) is formed by a sector-shaped projection (24) in the end surface of one adjustment shaft (7) and a sector-shaped projection (23) arranged above same in a facing end surface of the other adjustment shaft (7).

The sliding clutches are developed particularly simply if each sliding clutch is provided, for limiting the maximum possible relative movement, with a pin (25) which is passed radially through the corresponding adjustment shaft and two stop segments (26, 27) on the corresponding gear wheel (13B).

The interposing in each case of a gear between the corresponding setting motor and the corresponding setting shaft can be dispensed with if the setting motors (17, 18) are arranged, without the interpositioning of a gear, directly on the setting shafts (6, 7) of the throttle valves (4, 5). The setting shafts can, in this case, extend in alignment with each other so that the entrainment connection explained above can be used.

It is also possible for the setting shafts (6, 7) to extend parallel to each other and that, in order to form the entrainment connection (8) on each setting shaft (6, 7) in radial alignment, a setting segment (29, 30) having a slot (31, 32) in the form of a circular arc is provided, into which a coupling rod (33) which connects the setting segments (29, 30) to each other engages. With such an embodiment, the sliding clutches can be dispensed with. The entrainment connection, on its part, is of very simple construction.

BRIEF DESCRIPTION OF THE DRAWINGS

With the above and other objects and advantages in view, the present invention will become more clearly understood in connection with the detailed description of preferred embodiments, when considered with the accompanying drawing, of which.

DETAILED DESCRIPTION OF THE PREFERRED EMBODIMENTS

Figure 1:
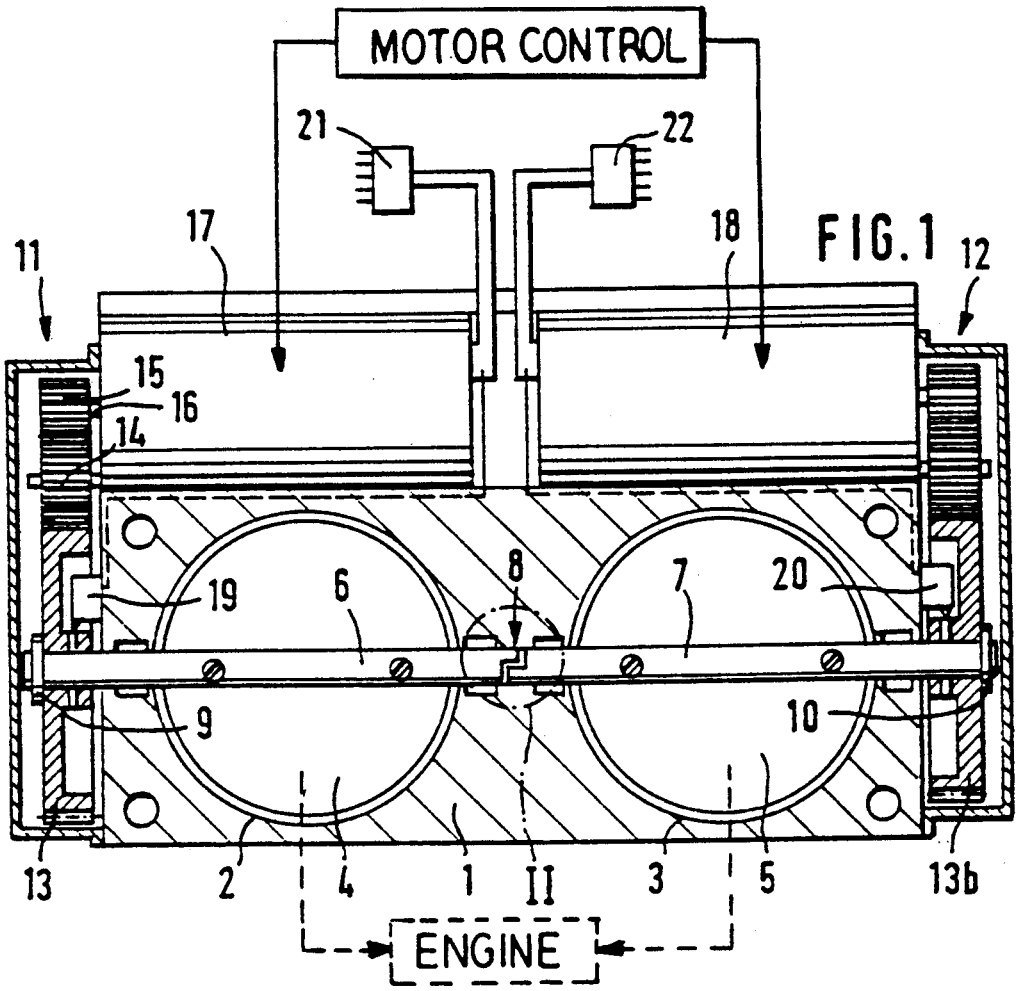
FIG. 1 is a cross section through the load adjustment device of the invention.

FIG. 1 shows a throttle-valve connection 1 which has two parallel-extending intake channels 2, 3 for directing air and fuel into an engine (indicated diagrammatically), each channel having a throttle valve 4, 5. The two throttle valves 4, 5 are arranged individually on horizontally arranged setting shafts 6, 7, the two shafts being aligned with each other and coupled to each other by an entrainment connection 8 which has play. Both setting shafts 6, 7 are extended laterally out of the throttle-valve connection 1 and connected there with a gearing 11, 12 by means of a sliding clutch 9, 10. Each gearing 11, 12 consists of three gear wheels 13, 14, 15 which mesh with each other, the gear wheel 15 being arranged fixed for rotation on a driven shaft 16 of a setting motor 17 developed as stepping motor. A second setting motor 18, which is also developed as stepping motor, is arranged as a mirror image to the first setting motor 17 on the top of the throttle-valve connection 1 and drives the setting shaft 7 in the same manner, via the gearing 12. A motor controller (indicated diagrammatically) is responsive to the position of an accelerator pedal (not shown) of the motor vehicle for electrically activating the motors 17 and 18 during conditions of power demand and idle of the engine.

As also shown in FIG. 1, each setting shaft 6, 7 has a safety switch contact 19, 20 associated with it, said contact 19, 20 being connected electrically to and setting off a warning device 21, 22 when the setting motor 17, 18 is under current but the setting shaft 6, 7 is not rotating.

Figure 2:
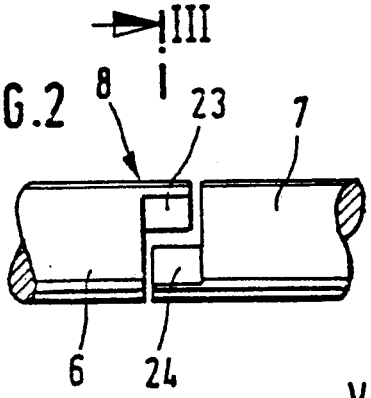
FIG. 2 is a view, on a larger scale than FIG. 1, of a detail designated II in FIG. 1.
Figure 3:
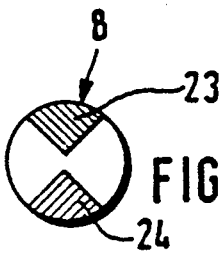
FIG. 3 is a section through the detail along the line III—III of FIG. 2.

FIGS. 2 and 3 show the development of the entrainment connection 8 in greater detail. Each of the end surfaces facing each other of the two setting shafts 6, 7 has a sector-shaped projection 23, 24. These projections comprise, in each case, an angle of 90 degrees, so that there remains between them also an angle of 90 degrees, as indicated in FIG. 3. If the throttle valves 4, 5 move in synchronism, then the projections 23, 24 lie opposite each other. If, for instance, the throttle valve 4 stops as the result of a defect, then the right throttle valve 5 can be swung unimpeded up to 90 degrees. The normal actuation of the right-hand throttle valve 5 would in such a case in no way be interfered with by the left throttle valve 4 which has failed. If the left throttle valve 4 has failed in open position, then the right throttle valve 5 can be swung by motor through an angle of 90 degrees, in which case, after an angle of swing of 90 degrees, the entrainment connection 8 carries the left throttle valve 4 along with it so that the latter can be closed. In this case, there is relative movement in the sliding clutch 9. After repair of the load adjustment device, this turning of the sliding clutch must be reset.

Figure 4:
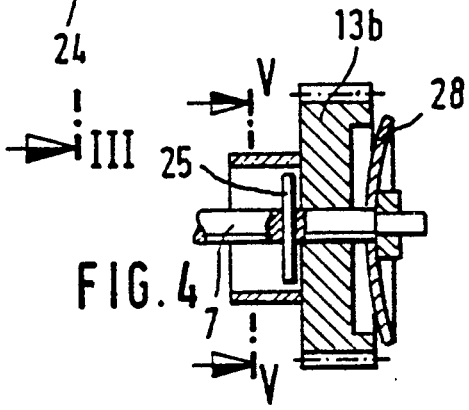
FIG. 4 is a showing, on a larger scale than FIG. 1, of the region of a gear wheel with a sliding clutch.
Figure 5:
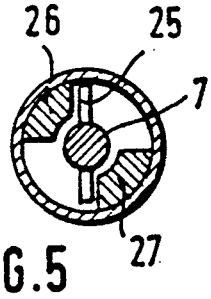
FIG. 5 is a section through the sliding clutch of FIG. 4.

FIGS. 4 and 5 show the development of the sliding clutch 12. It can be seen that the gear wheel 13*b* is connected by friction lock to the setting shaft 7 via a cup spring 28. A pin 25 extends radially through the setting shaft 7. The gear wheel 13*b* is capable of coming against the pin 25 by means of the stop segments 26, 27 shown in FIG. 5 upon rotation in clockwise direction so that the setting shaft 7 is entrained in form-locked manner. If the gear wheel 13*b* turns in counterclockwise direction and if the setting shaft 7 is sufficiently sluggish, then there is relative movement between the gear wheel 13*b* and the setting shaft 7 until, in each case, the other side of the stop segment 26, 27 comes against the pin 25 and then carries the setting shaft 7 along with it. Since both gears 11, 12 have such a sliding clutch 9, 10, the throttle valve which is no longer functional can be moved into closed position upon the blocking of a gearing 11, 12 via the other gearing, based on a sliding slide clutch.

Figure 6:
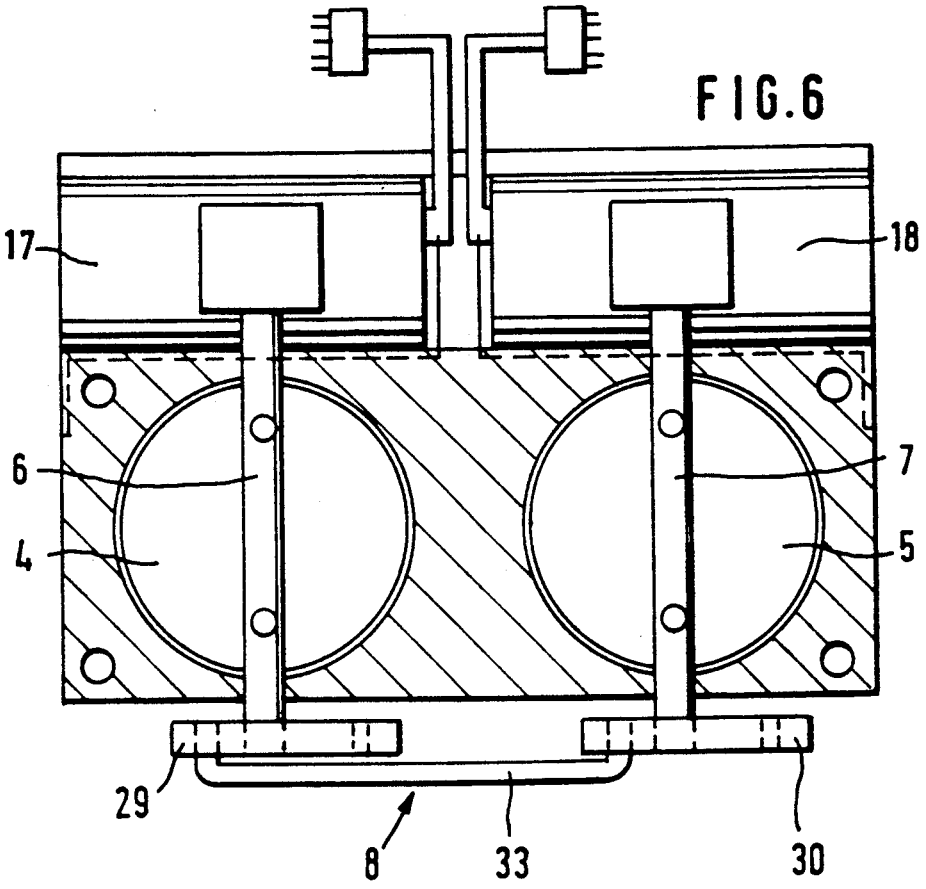
FIG. 6 is a diagrammatic cross section through a second embodiment of the load adjustment device of the invention.
Figure 7:
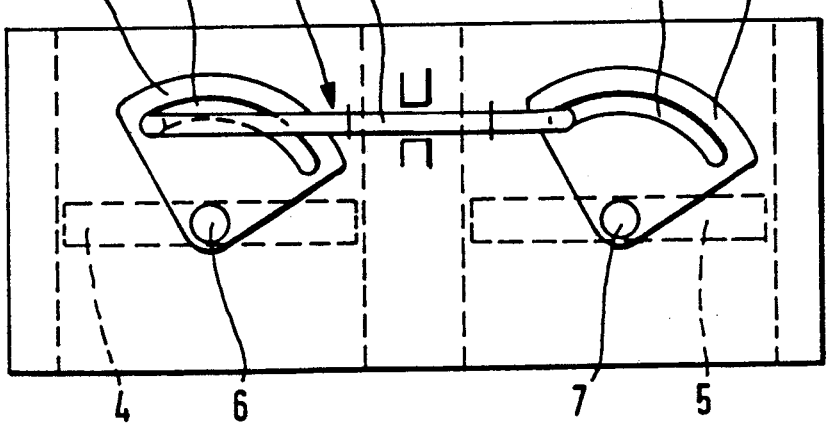
FIG. 7 is a front view of the load adjustment device of FIG. 6.

In the embodiment shown in FIGS. 6 and 7, parts functionally identical to the preceding figures have been provided with the same reference numbers. In this embodiment, the setting shafts 6, 7 are not aligned axially but extend parallel to each other. Each setting shaft 6, 7 is driven in each case directly by a setting motor 17, 18. The entrainment connection 8 is again so developed that both throttle valves 4, 5 can swing independently of each other up to a maximum of about 90 degrees. Upon further swinging, the other throttle valve 4 or 5, as the case may be, is carried along by the entrainment connection 8.

The construction of the entrainment connection 8 can be noted from FIG. 7. On each setting shaft 6, 7 it has a setting plate or segment 29, 30 with, in each case, a slot 31, 32 of arcuate shape. The ends of a coupling rod 33 engage in corresponding ends of the slots 31, 32. In the closed position of the throttle valves 4 and 5 shown, the coupling rod 33 lies, in each case, against a left-hand limitation of the corresponding slot 31, 32. If, for example, the right-hand throttle valve 5 can no longer be actuated by the associated setting motor 18, then the right-hand throttle valve 5, after a swinging of the left-hand throttle valve 4 by 90 degrees, is carried along by the coupling rod 33 so that it can be moved into closed position.

I claim:

1. A load adjustment device for an internal combustion engine, the device comprising a first intake channel to the engine, and a first throttle valve located in the first intake channel;

a first setting shaft connected to the first throttle valve;

a first setting motor for actuating the first setting shaft;

a second intake channel to the engine arranged parallel to the first intake channel;

a second throttle valve arranged in said second intake channel;

a second setting shaft connected to the second throttle valve;

a second setting motor for actuating the second setting shaft for driving the second throttle valve;

an entrainment connection having play; and wherein both of said throttle valves are swingable in their respective intake channels, said first and said second setting shafts being connected to each other by said entrainment connection.

2. A device according to claim 1, wherein the setting motors are formed as stepping motors.

3. A device according to claim 2, wherein each of said setting motors includes a gearing; and said setting motors are arranged as mirror images to each other above or below the two intake channels and are connected to corresponding ones of said setting shafts via the respective gearings, the gearings being arranged laterally of the corresponding intake channels.

4. A device according to claim 3, further comprising sliding clutches which permit limited rotary movement, individual ones of the clutches being connected respectively between the gearing and the setting shaft of each one of the setting motors.

5. A device according to claim 4, wherein the play of the entrainment connection, in the case of each of said throttle valves, is directed in the same direction, in an amount of about 90 degrees; and the two sliding clutches are configured to engage by form-locking after a relative rotation of 90 degrees.

6. A device according to claim 5, further comprising a control device for actuating only one of said setting motors for idling adjustment and for the synchronous actuation of both throttle valves in operation under load.

7. A device according to claim 1, further comprising a first and second safety contact connected respectively to said first and said second shaft for monitoring rotary movement of the corresponding shafts.

8. A device according to claim 1, wherein said entrainment connection comprises a first sector-shaped projection in an end surface of said first shaft and a second sector-shaped projection in an end surface of said second shaft facing the end surface of said first shaft, the second projection extending alongside the first projection.

9. A device according to claim 5, wherein each sliding clutch comprises a first portion connected to a gear and a second portion connected to a shaft, the first portion of the clutch including two stop segments, and the second portion of the clutch including a pin which is connected radially relative to an axis of the shaft for engagement with the two stop segments; and the pin acts with the two stop segments for a limiting of the maximum possible movement between the first and the second portions of the clutch.

10. A device according to claim 1, wherein the setting motors are connected directly to the respective setting shafts of the respective throttle valves.

11. A device according to claim 10, wherein the setting shafts extend parallel to each other; and said entrainment connection comprises a first and a second setting plate having a slot in the form of a circular arc, said first and said second plates being located on ends respectively of said first shaft and said second shaft and in radial alignment with each other;

a coupling rod connecting the setting plates and having opposed ends which engage respective ones of said slots of the setting plates.

12. A device according to claim 2, wherein the setting motors are connected directly to the respective setting shafts of the respective throttle valves.

* * * * *